US005843873A

United States Patent [19]

Butke et al.

[11] Patent Number: 5,843,873

[45] Date of Patent: Dec. 1, 1998

[54] LUBRICANTS AND FLUIDS CONTAINING THIOCARBAMATES AND PHOSPHORUS

[75] Inventors: Betsy J. Butke, Mentor; Craig D. Tipton, Perry; Reed H. Walsh, Mentor, all of Ohio

[73] Assignee: The Lubrizol Corporation, Wickliffe, Ohio

[21] Appl. No.: 881,411

[22] Filed: Jun. 24, 1997

Related U.S. Application Data

[63] Continuation of Ser. No. 650,930, May 17, 1996, abandoned, which is a continuation of Ser. No. 340,099, Nov. 15, 1994, abandoned.

[51] Int. Cl.[6] ..... C10M 141/02; C10M 141/06; C10M 141/10; C10M 141/12

[52] U.S. Cl. ..... 508/185; 508/187; 508/221; 508/229; 508/269; 508/428; 508/438; 508/439; 508/448; 508/454; 508/543; 252/77; 252/78.1

[58] Field of Search ..... 508/438, 464, 508/487, 185, 187, 221, 229, 269, 428, 439, 448, 454, 543; 252/77, 78.1

[56] References Cited

U.S. PATENT DOCUMENTS

| | | | |
|---|---|---|---|
| 3,865,906 | 2/1975 | Schroeck | 260/953 |
| 3,876,550 | 4/1975 | Holubec | 252/47.5 |
| 3,890,363 | 6/1975 | Malec | 252/47.5 |
| 4,226,732 | 10/1980 | Reinhard et al. | 252/47.5 |
| 4,304,678 | 12/1981 | Schick et al. | 252/56 R |
| 4,360,438 | 11/1982 | Rowan et al. | 252/33.6 |
| 4,501,678 | 2/1985 | Katayama et al. | 252/47.5 |
| 4,609,480 | 9/1986 | Hata et al. | 252/32.7 |
| 4,717,490 | 1/1988 | Salentine | 252/32.7 |
| 4,758,362 | 7/1988 | Butke | 252/47.5 |
| 4,879,054 | 11/1989 | Waynick | 252/41 |
| 4,957,651 | 9/1990 | Schwind | 252/56 |
| 4,959,168 | 9/1990 | Schroeck | 252/48.6 |
| 5,114,603 | 5/1992 | Kennedy et al. | 252/56 |
| 5,133,888 | 7/1992 | Waynick | 252/33.4 |

FOREIGN PATENT DOCUMENTS

| | | | |
|---|---|---|---|
| 0208541 | 7/1986 | European Pat. Off. | C10M 169/04 |
| 604232 | 6/1994 | European Pat. Off. . | |
| 8805810 | 8/1988 | WIPO . | |
| WO9219703 | 11/1992 | WIPO | C10M 141/10 |

*Primary Examiner*—Margaret Medley
*Attorney, Agent, or Firm*—David M. Shold

[57] ABSTRACT

Lubricants containing a compound of the structure $$R_1R_2N—C(X')S—(CR_3R_4)_aY$$

where X' is an oxygen or sulfur atom and Y is, e.g., an activating group; also containing a phosphorus acid or ester of the formula $(R_6X)(R_7X)P(X)_nX_mR_8$ or an amine salt thereof; and also a surfactant, exhibit good antiwear properties. They are particularly useful in pressure transmitting applications such as tractor hydraulic fluids.

47 Claims, No Drawings

LUBRICANTS AND FLUIDS CONTAINING THIOCARBAMATES AND PHOSPHORUS

This is a continuation of application(s) Ser. No. 08/650,930 filed May 17, 1996 which is in turn a continuation of Ser. No. 08/340,099, filed Nov. 15, 1994 now both abandoned.

BACKGROUND OF THE INVENTION

The present invention relates to additives and compositions useful as lubricants and functional fluids with good extreme pressure and antiwear properties.

U.S. Pat. No. 4,609,480, Hata et al., Sep. 2, 1986, discloses a lubricant composition comprising (a) a dithiocarbamic acid ester and/or an alkyl thiocarbamoyl compound and (b) a 1,3,4-thiadiazole compound. A third additive can be present, such as phosphoric acid esters and phosphorus esters such as mono-, di-, or tri-butylphosphite.

U.S. Pat. No. 4,758,362, Butke, Jul. 19, 1988, discloses carbamate additives for low phosphorus or phosphorus free lubricating compositions. The additive has the formula

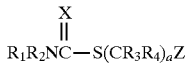

where X is O or S and Z one of several listed groups. These additives are said to impart improved extreme pressure and anti-wear properties to lubricant compositions. The compositions can contain other additives and chemistries.

U.S. Pat. No. 4,360,438, Rowan et al., Nov. 23, 1982, discloses a synergistic antiwear composition comprising a sulfurized molybdenum dialkyldithiocarbamate and an organic sulfur compound selected from the group consisting of dithiocarbamate acid esters, sulfurized oils, and polysulfurized olefins. The esters of dithiocarbamic acid can have the formula

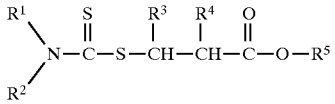

Sulfur-phosphorus type additives can also be present.

SUMMARY OF THE INVENTION

The present invention provides a composition which exhibits good anti-wear performance. The present invention includes a composition of matter comprising:

(a) an oil of lubricating viscosity;

(b) a compound of the structure

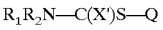

where $R_1$ and $R_2$ independently hydrogen or hydrocarbyl groups; X' is an oxygen or sulfur atom; and Q is an alkyl group or an alkyl group containing at least one substituent selected from the group consisting of activating groups, hydrocarbyl groups, hetero groups, and —SC(X')—$NR_1R_2$ groups, groups $R_1$, $R_2$, and Q containing in total at least 4 carbon atoms;

(c) a phosphorus acid or ester of the formula $(R_6X)(R_7X)P(X)_nX_mR_8$ or an amine salt thereof, where each X is independently an oxygen atom or a sulfur atom, n is 0 or 1, m is 0 or 1, n+m is 1 or 2, and $R_6$, $R_7$, and $R_8$ are hydrogen hydrocarbyl groups; and (d) a surfactant.

The invention further provides lubricants and functional fluids, including tractor hydraulic fluids, containing the above compositions.

DETAILED DESCRIPTION OF THE INVENTION

The present invention provides a composition which can serve as a tractor hydraulic fluid with improved properties. Specifically, the compositions exhibit improved anti-wear performance, good rust inhibition, good water tolerance, and good oxidation performance. Certain formulations, in particular, are capable of passing the JDQ-95 spiral bevel test, a test standard for tractor hydraulic fluids, established by John Deere & Company Engineering Standards Department, John Deere Rd., Moline, Ill. 61265. Other applications in which the present composition or equivalents thereof can be advantageously used include crankcase lubricating oils for spark-ignited and compression-ignited internal combustion engines, including automobile and truck engines, two-cycle engines, aviation piston engines, and marine and railroad diesel engines. They can also be used in gas engines and stationary power engines and turbines. Automatic or manual transmission fluids, transaxle lubricants, gear lubricants, including open and enclosed gear lubricants, tractor lubricants, metal-working lubricants, hydraulic fluids, and other lubricating oil and grease composition can also benefit from the incorporation therein of the compositions of the present invention. They can also be used as wirerope, walking cam, way, rock drill, chain and conveyor belt, worm gear, bearing, and rail and flange lubricants.

The oil of lubricating viscosity

The first and major component of this invention is an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydrotreated mineral oil or a synthetic lubricating oil, such as a polyolefin. Examples of useful oils of lubricating viscosity include XHVI basestocks, such as 100N isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N solvent refined paraffinic mineral oil (0.16% sulfur/89 VI), 200N solvent refined naphthenic mineral oil (0.2% sulfur/60 VI), 100N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). For further description of oils of lubricating viscosity, attention is directed to U.S. Pat. No. 4,582,618 (column 2, line 37 through column 3, line 63, inclusive).

In one embodiment, the oil of lubricating viscosity is a polyalpha-olefin (PAO). Typically, the polyalpha-olefins are derived from monomers having from 4 to 30, or from 4 to 20, or from 6 to 16 carbon atoms. Examples of useful PAOs include those derived from decene. These PAOs may have a viscosity from 3 to 150, or from 4 to 100, or from 4 to 8 cSt at 100° C. Examples of PAOs include 4 cSt polyolefins, 6 cSt polyolefins, 40 cSt polyolefins and 100 cSt polyalphaolefins.

In one embodiment, the lubricating composition contains an oil of lubricating viscosity which has an iodine value of less than about 9, determined according to ASTM D-460. In one embodiment, the oil of lubricating viscosity has a iodine value less than 8, or less than 6, or less than 4.

In one embodiment, the oil of lubricating viscosity are selected to provide lubricating compositions with a kinematic viscosity of at least 3.5 cSt, or at least 4.0 cSt at 100° C. In one embodiment, the lubricating compositions have an SAE gear viscosity grade of at least SAE 75W. The lubricating composition may also have a so-called multigrade rating such as SAE 75W-80, 75W-90, 75W-140, 80W-90, 80W-140, 85W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol™ 3174 available from The Lubrizol Corporation.

In one embodiment, the oil of lubricating viscosity includes at least one ester of a dicarboxylic acid. Typically the esters contain from 4 to 30, preferably from 6 to 24, or from 7 to 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

The lubricating oil in the invention will normally comprise the major amount of the composition. Thus it will normally be at least 50% by weight of the composition, preferably 83 to 98%, and most preferably 88 to 96%. As an alternative embodiment, however, the present invention can provide an additive concentrate in which the oil can be 0 to 20% by weight, preferably 1 to 10%, alternatively, 1 to 20%, and the other components, described in greater detail below, are proportionately increased. Alternatively, the amount of oil of lubricating viscosity can be greater than 20% by weight of the composition.

The thiocarbamate compound

The second component (b) of the present composition is a compound of the structure $R_1R_2N—C(X)S—Q$, where $R_1$ and $R_2$ are independently hydrogen or hydrocarbyl groups; X is O (oxygen) or preferably S (sulfur); and Q is an alkyl group or an alkyl group containing at least one substituent selected from the group consisting of hydrocarbyl groups, hetero groups (that is, a group attached through a heteroatom such as O, N, or S), additional $—SC(X)—NR_1R_2$ groups, or, preferably, activating groups. Groups $R_1$, $R_2$, and Q should contain in total at least 4, preferably at least 6, and more preferably at least 8 carbon atoms. In a preferred embodiment, Q is $(CR_3R_4)_aY$, wherein $R_3$ and $R_4$ are independently hydrogen or hydrocarbyl groups, a is 1 or 2, and Y is the hydrocarbyl group, hetero group, $—SC(X)—NR_1R_2$ group, or activating group.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) heteroatom-containing substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

When a in the above formula is 2, Y is preferably an activating group. In describing Y as an "activating group," what is meant is a group which will activate an olefin to which it is attached toward nucleophilic addition by, e.g., $CS_2$ or COS derived intermediates. (This is reflective of the method by which the material of this component is normally prepared, by reaction of an activated olefin with $CS_2$ and an amine.) The activating group Y can be, for instance, an ester group, typically but not necessarily a carboxylic ester group of the structure $—COOR_5$. It can also be an ester group based on a non-carbon acid, such as a sulfonic or sulfinic ester or a phosphonic or phosphinic ester. The activating group can also be any of the acids or salts corresponding to the aforementioned esters. Y can also be an amide group, that is, based on the condensation of an acid group, preferably a carboxylic acid group, with an amine. In that case the $—(CR_3R_4)_aY$ group could be suitably derived from acrylamide. Y can also be an ether group, $—OR_5$; a carbonyl group, that is, an aldehyde or a ketone group; a cyano group, —CN, or an aryl group. In a preferred embodiment Y is an ester group of the structure, $—COOR_5$, where $R_5$ is a hydrocarbyl group. $R_5$ can preferably comprise 1 to 18 carbon atoms, preferably 1 to 6 carbon atoms. Most preferably $R_5$ is methyl so that the activating group is $—COOCH_3$. $R_5$ can be a hydrocarbyl group derived from a mono- or a polyalcohol; in the latter instance, the polyfunctional $R_5$ alcohol can be reacted with a plurality of $R_1R_2N—C(X)S—(CR_3R_4)_aCOO—$ groups.

When a is 1, Y need not be an activating group, because the molecule is generally prepared by methods, described below, which do not involve nucleophilic addition to an activated double bond.

Groups $R_3$ and $R_4$ are preferably independently hydrogen or methyl or ethyl groups. When a is 2, at least one of $R_3$ and $R_4$ is normally hydrogen so that this component will be $R_1R_2N—C(S)S—CR_3R_4CR_3HCOOR_5$. Preferably most or all of the $R_3$ and $R_4$ groups are hydrogen so that this component of the composition will be $R_1R_2N—C(S)S—CH_2CH(CH_3)COOCH_3$ or preferably $R_1R_2N—C(S)S—CH_2CH_2COOCH_3$. (These materials can be seen as derivable from methyl methacrylate and methyl acrylate, respectively.) These and other materials containing appropriate activating groups are disclosed in greater detail in PCT publication WO87/05622, equivalent to U.S. Pat. No. 4,758,362.

The substituents $R_1$ and $R_2$ on the nitrogen atom are likewise hydrogen or hydrocarbyl groups, but at least one should preferably be a hydrocarbyl group. It is generally believed that at least one such hydrocarbyl group is desired in order to provide suitable oil-solubility to the molecule. However, $R_1$ and $R_2$ can both be hydrogen, provided the other groups in the molecule provide sufficient oil solubility. In practice this means that one of the groups $R_3$ or $R_4$ could be a hydrocarbyl group of at least 4 carbon atoms. $R_1$ or $R_2$ are preferably alkyl groups of 1–18 carbon atoms, preferably alkyl groups of 1–8 carbon atoms. In a particularly preferred embodiment, both $R_1$ and $R_2$ are butyl groups. Thus a particularly preferred embodiment of this component of the composition has the formula

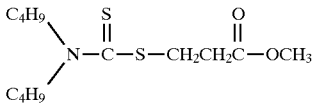

(I)

Materials of this type can be prepared by a process more fully described in PCT publication WO87/05622. The materials are derived from an amine such as those described in detail below, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40°–65° C.), the reaction mixture is held at temperature to insure complete reaction. After a reaction time of typically 3–5 hours, the volatile materials are removed under reduced pressure and the residue is filtered to yield the final product.

The relative amounts of the reactants used to prepare the compounds of this component are not particularly critical. The charge ratios to the reactor can vary where economics and the amount of the product desired are controlling factors. Thus, the charge ratio of the amine to the $CS_2$ or COS reactant to the ethylenically unsaturated reactant may vary in the ranges 5:1:1 to 1:5:1 to 1:1:5. As a preferred embodiment, the charge ratios of these reactants will be 1:1:1.

In the case where a is 1, the activating group Y is separated from the sulfur atom by a methylene group. Materials of this type can be prepared by reaction of sodium dithiocarbamate with a chlorine substituted material. Such materials are described in greater detail in U.S. Pat. No. 2,897,152.

It is preferred that the amount of component (b) in the composition of the present invention will be 0.1 to 10 percent by weight; more preferably 0.5 to 5% by weight, and still more preferably 1.5 to 3% by weight. The amount of this component will be proportionately increased if the composition takes the form of a concentrate.

The phosphorus compound

A third component of the present invention is a phosphorus acid or ester of the formula $(R_6X)(R_7X)P(X)_nX_mR_8$ or an amine salt thereof, where each X is independently an oxygen atom or a sulfur atom, n is 0 or 1, m is 0 or 1, m+n is 1 or 2, and $R_6$, $R_7$, and $R_8$ are hydrogen or hydrocarbyl groups. Preferably at least one of $R_6$, $R_7$, and $R_8$ is a hydrocarbyl group, and preferably at least one is hydrogen. This component thus includes phosphorous and phosphoric acids, thio-phosphorous and thiophosphoric acids, phosphite esters, phosphate esters, and thiophosphite and thiophosphate esters. The esters can be mono-, di- or tri-hydrocarbyl esters. It is noted that certain of these materials can exist in tautomeric forms, and that all such tautomers are intended to be encompassed by the above formula and included within the present invention. For example, phosphorous acid and certain phosphite esters can be written in at least two ways:

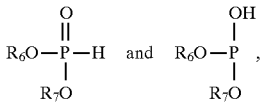

differing merely by the placement of the hydrogen. Each of these structures are intended to be encompassed by the present invention.

It is preferred that at least two of the X atoms in the above structure are oxygen, so that the structure will be $(R_6O)(R_7O)P(X)_nX_mR_8$, and more preferably $(R_6O)(R_7O)P(X)_nX_mH$. This structure can correspond, for example, to phosphoric acid when $R_6$, $R_7$, and $R_8$ are hydrogen, or to a mono- or dialkyl hydrogen phosphite (a phosphite ester) when one or both of $R_6$ and $R_7$ are alkyl, respectively and $R_8$ is hydrogen, or a trialkyl phosphite ester when each of $R_6$, $R_7$, and $R_8$ is alkyl; in each case where n is zero, m is 1, and the remaining X is O. The structure will correspond to phosphoric acid or a related material when n and m are each 1; for example, it can be a phosphate ester such as a mono-, di- or trialkyl monothiophosphate when one of the X atoms is sulfur and one, two, or three of $R_6$, $R_7$, and $R_8$ are alkyl, respectively.

Phosphoric acid and phosphorus acid are well-known items of commerce. Thiophosphoric acids and thiophosphorous acids are likewise well known and are prepared by reaction of phosphorus compounds with elemental sulfur or other sulfur sources. Processes for preparing thiophosphorus acids are reported in detail in *Organic Phosphorus Compounds,* Vol. 5, pages 110–111, G. M. Kosolapoff et al., 1973.

When component (c) is a phosphite ester, the hydrocarbyl groups $R_6$ and $R_7$ will normally contain 1 to 30 or 24 carbon atoms, preferably 2 to 12 or 8 carbon atoms, and more preferably 4 to 8 carbon atoms. In a preferred embodiment the hydrocarbyl groups are alkyl groups and, in particular, butyl groups.

The $R_6$ and $R_7$ groups can comprise a mixture of hydrocarbyl groups derived from commercial alcohols. Examples of some preferred monohydric alcohols and alcohol mixtures include the commercially available Alfol™ alcohols marketed by Continental Oil Corporation Alfol™ 810 is a mixture containing alcohols consisting essentially of straight-chain primary alcohols having from 8 to 10 carbon atoms. Alfol™ 12 is a mixture comprising mostly $C_{12}$ fatty alchols. Alfol™ 1218 is a mixture of synthetic primary straight chain alchols having 12 to 18 carbon atoms. The Alfol™20+ alcohols are mostly, on an alcohol basis, $C_{20}$ alcohols as determined by gas-liquid chromatography. The Alfol™22+ alchols are $C_{18-20}$ primary alchols having mostly, on an alcohol basis, $C_{22}$ alchols. These Alfol™ alchols can contain a fairly large percentage (up to 40% by weight) of paraffinic compounds which can be removed before the reaction if desired.

Another commercially available alcohol mixture is Adol™ 60 which comprises about 75% by weight of a straight-chain $C_{22}$ primary alcohol, about 15% of a $C_{20}$ primary alcohol, and about 8% of $C_{18}$ and $C_{24}$ alcohols. Adol™ 320 comprises predominantly oleyl alcohol. The Adol™ alcohols are marketed by Ashland Chemical.

A variety of mixtures of monohydric fatty alcohols derived from naturally occurring triglycerides and ranging in chain length from $C_8$ to $C_{18}$ are available from Procter & Gamble Company. These mixtures contain various amounts of fatty alcohols containing mainly 12, 14, 16, or 18 carbon atoms. For examples, CO-1214™ is a fatty alcohol mixture containing 0.5% $C_{10}$ alcohol. 66ˆ $C_{12}$ alcohol, 26% $C_{14}$ alcohol, and 6.5% $C_{16}$ alcohol.

Another group of commercially available mixtures include the Neodol™ products available from Shell Chemical Co. For example, Neodol™ 23 is a mixture of $C_{12}$ and $C_{15}$ alcohols; Neodol™ 25 is a mixture of $C_{12}$ and $C_{15}$ alcohols, and Neodol™ 45 is a mixture of $C_{14}$and $C_{15}$ linear alchols. Neodol™ 91 is a mixture of $C_9$, $C_{10}$, and $C_{11}$ alcohols.

Other alcohols which can be used are lower molecular weight alcohols such as methanol, ethanol, propanol, isopropanol, normal butanol, isobutanol, tert-butanol, the pentanols, hexanols, heptanols, octanols (including 2-ethyl hexanol), nonanols, decanols, and mixtures thereof.

The dihydrocarbyl hydrogen phosphites of this invention can be prepared by techniques well known in the art, and many such phosphites are available commercially. In one method of preparation, a lower molecular weight dialkylphosphite (e.g., dimethyl) is reacted with alcohols comprising a straight-chain alcohol, a branched-chain alcohol, or mixtures thereof. As noted above, each of the two types of alcohols may themselves comprise mixtures. Thus, the straight-chain alcohol can comprise a mixture of straight-chain alcohols and the branched-chain alcohol can comprise a mixture of branched-chain alcohols. The higher molecular weight alcohols replace the methyl groups in a manner analogous to classic transesterification, with the formation of methanol which is stripped from the mixture. In another embodiment, the branched-chain hydrocarbyl group can be introduced into a dialkylphosphite be reacting the low molecular weight dialkylphosphite such as dimethylphosphite with a more sterically hindered branched-chain alcohol such as neopentyl alcohol (2,2-dimethyl-1-propanol). In this reaction, one of the methyl groups is replaced by a neopentyl group and, perhaps because of this of the neopentyl group, the second methyl group is not displaced. Another neo alcohol having such utility is 2,2,4-trimethyl-1-pentanol. One preferred material is dibutyl hydrogen phosphite, which is commercially available from a variety of sources including Mobil Chemical Company.

For further information and examples of the preparation of specific dialkylphosphites, attention is directed to PCT publication WO88/05810.

The phosphoric acid esters (phosphates) can generally be prepared by reacting one or more phosphorus acids or esters with one or more of the alcohols described above. The phosphorus acid or anhydride is generally an inorganic phosphorus reagent, such as phosphorus pentoxide, phosphorus trioxide, phosphorus tetraoxide, a phosphorus acid, a phosphorus halide, lower phosphorus esters, or phosphorus sulfides.

Thiophosphorus esters can be prepared by reacting a phosphorus sulfide, such as those described above, with one or more of the alcohols described above. On one embodiment, the phosphoric acid ester is a monothiophosphoric acid ester. The sulfur source can be, for instance, elemental sulfur or a monosulfide such as a sulfur coupled olefin or a sulfur coupled dithiophosphate. Elemental sulfur is a preferred sulfur source. For further details on the preparation of monothiophosphate and sulfur sources, attention is directed to U.S. Pat. No. 4,775,311. Monothiophosphate can also be formed in situ in a lubricant blend by adding a dihydrocarbyl phosphite to a lubricating composition containing a sulfur source such as a sulfurized olefin. The phosphite can also react with a sulfur source under blending conditions (i.e., temperatures of 30° to 100° C. or higher) to form a monothiophosphate.

Acidic phosphoric acid esters can be reacted with a metallic base or, preferably, an amine compound to form an amine or metal salt. The salts can be formed separately and added to the lubricating composition; alternatively, the salt can be formed in situ when an acidic phosphorus acid ester is blended with other components to form a fully formulated lubricating composition.

Amine salts of phosphoric acid esters can be formed from ammonia or an amine. Suitable amines include monoamines and polyamines. The amines can be aliphatic, cycloaliphatic, aromatic, or heterocyclic, including mixtures thereof, and can be saturated or unsaturated. The amines can also generally contain non-hydrocarbon substituents or groups. Such non-hydrocarbon sub-stituents or groups include lower alkoxy, lower alkylmercapto, nitro, interrupting groups such as —O— and —S— (e.g., as in such groups as —$CH_2CH_2$—X—$CH_2CH_2$— where X is —O— or —S—). In general, the amines can be characterized by the formula $NR^7R^8R^9$ wherein $R^7$, $R^8$, and $R^9$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl, or acylimidoyl groups, provided that not all of $R^7$, $R^8$, and $R^9$ are hydrogen. In a preferred embodiment $R^7$ is an aliphatic hydrocarbyl group having 8–24 carbon atoms. In another preferred embodiment $R^8$ and $R^9$ are hydroxy-substituted hydrocarbon or hydroxy substituted ether or polyether groups of the formula $H[O(CR_2)_a]_b$—. A preferred group of this type is hydroxyethyl; a preferred amine is di(hydroxyethyl)eoleylamine or mixed amines having similar $C_{18}$ alkyl substituents, for example, materials sold under the name Ethomeen™ from Akzo Chemicals. These amines are made by treatment of the corresponding alkyl amine with the appropriate alkoxide.

More generally, with the exception of the branched polyalkylenepolyamines, the polyoxy-alkylenepolyamines, and the high molecular weight hydrocarbyl-substituted amines described more fully hereafter, the amines ordinarily contain less than 40 carbon atoms in total and usually not more than 20 carbon atoms in total.

Aliphatic monoamines include mono-aliphatic, di-aliphatic, and tri-aliphatic substituted amines wherein the aliphatic group can be saturated or unsaturated and straight or branched chain. Thus, they are primary, secondary, or tertiary aliphatic amines. Specific examples of such monoamines include ethylamine, diethylamine, triethylamine, n-butylamine, di-n-butylamine, tri-n-butylamine, allylamine, isobutylamine, cocoamine, stearylamine, laurylamine, methyllaurylamine, oleylamine, N-methyl-octylamine, dodecylamine, and octadecylamine.

Cycloaliphatic monoamines are those monoamines wherein there is one cycloaliphatic substituent attached directly to the amino nitrogen. Examples of cycloaliphatic monoamines include cyclohexylamines, cyclopentylamines, cyclohexenylamines, cyclopentenylamines, N-ethylcyclohexylamine, dicyclohexylamines, and the like. Heterocyclic monoamines are monoamines in which the amine nitrogen forms a part of the cyclic ring structure. Examples include piperidine, pyrrolidine, and morpholine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl) amine, naphthylamine, and N,N-di(butyl)aniline. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

The amine which forms the salt in the present invention can also be a polyamine. The polyamine can be aliphatic, cycloaliphatic, heterocyclic or aromatic. Examples of the polyamines include alkylenepolyamines, hydroxy-containing polyamines, arylpolyamines, and heterocyclic polyamines.

Alkylene polyamines are represented by the formula

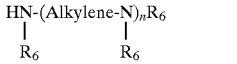

$$\underset{\underset{R_6}{|}}{HN}\text{-(Alkylene-}\underset{\underset{R_6}{|}}{N})_nR_6 \qquad \text{(IV)}$$

wherein n has an average value from 1 or 2 to 10, 7, or 5, and the "Alkylene" group has from 1 or 2 to 10, 6, or 4 carbon atoms. Each $R_6$ is independently hydrogen, or an aliphatic or hydroxy-substituted aliphatic group of up to 30 carbon atoms.

Such alkylenepolyamines include methylenepolyamines, ethylenepolyamines, propylenepolyamines, butylenepolyamines, and pentylenepolyamines. The higher homologues and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, and pentaethylenehexamine.

Higher homologues obtained by condensing two or more of the above-noted alkylene amines are similarly useful as are mixtures of two or more of the aforedescribed polyamines.

Ethylenepolyamines are described in detail under the heading Ethylene Amines in Kirk Othmer's "Encyclopedia of Chemical Technology," 2d Edition, Vol. 7, pages 22–37, Interscience Publishers, New York (1965). Ethylenepolyamine mixtures are also useful. Other useful types of polyamine mixtures are those resulting from stripping of the above-described polyamine mixtures to leave as residue what is often termed "polyamine bottoms."

One suitable class of amines in the present application is the alkyl primary amine, including branched primary amines, such as in particular $C_{8-18}$ tertiary alkyl primary amines. Preferably the alkyl group contains 11–14 or 12–14 carbon atoms. One such material is sold under the trade name Primene™ 81R, available from Rohm and Haas Company, which is believed to be a mixture of $C_{12-14}$ tertiary alkyl primary amines. Other related materials include Primene™ JMT, which is a mixture of $C_{18-22}$ tertiary alkyl primary amines. Tertiary aliphatic primary amines and methods for their preparation are known in the art and are described in U.S. Pat. No. 2,945,749.

For further information on phosphate and thiophosphate esters, their preparation, and amine salts thereof, attention is directed to European patent publication 604 232.

The amount of the phosphorus acid, ester, or amine salt component in the present invention is generally 0.05 to 8 percent by weight of the total composition. Preferably the amount is 0.07 to 2 percent by weight, and more preferably 0.1 to 1 percent by weight. If the present composition is used in the form of a concentrate, the amount of this component will be increased proportionately.

The surfactant

A fourth component of the composition of the present invention is (d) a surfactant. Surfactants (sometimes more narrowly referred to as dispersants) are well-known materials, which can be generally classified as anionic, cationic, zwitterionic, or non-ionic. Anionic surfactants include substances containing a long lipophilic tail bonded to a water-soluble (hydrophilic) group, wherein the hydrophilic group contains an anionic moiety derived from a carboxylic acid, sulfonic acid, or phenol, by neutralizing with an alkali metal or an amine. The lipophilic tail is preferably an alkyl group, typically having 8 to 21 carbon atoms.

Typical anionic surfactants include carboxylic acid salts such as fatty acid salts having the formula $R_1COOZ$ wherein $R_1$ is a straight chain, saturated or unsaturated, hydrocarbon radical of 8 to 21 carbon atoms and Z is a base-forming radical such as $Li^+$, $Na^+$, $K^+$, or $NH_4^+$ which makes the detergent-like surfactant soluble in water or increases its affinity to water. Alternatively Z may be a divalent or polyvalent metal, in which case the appropriate number of acid groups are normally present in order to provide the neutral salt. Multivalent metal ions can be derived from metals including Mg, Ca, Sr, Ba, Cr, Mn, Fe, Co, Ni, Cu, Zn, Sn, Pb, and others. Typical fatty acid salts include sodium stearate, sodium palmitate, ammonium oleate, and triethanolammonium palmitate. Additional carboxylic acid salts useful as anionic surfactants include salts, and especially sodium and potassium salts, of coconut oil fatty acids and tall oil acids as well as other carboxylic acids salt compounds including amine salts such as triethanolamine salts, acylated polypeptides, and salts of N-lauryl sarcosine such as N-dodecanoyl-N-methylglycine sodium salt.

Other anionic surfactants include aryl and alkaryl sulfonates such as linear and branched alkylbenzene sulfonates, sodium tetrapropylene benzene sulfonate, sodium dodecylbenzene sulfonate, toluene-, xylene-, and cumene sulfonates, lignin sulfonates, petroleum sulfonates, paraffin sulfonates, secondary n-alkanesulfonates, α-olefin sulfonates, alkylnaphthalene sulfonates, N-acyl-N-alkyltaurates, sulfosuccinate esters, isethionates, alkyl sulfates having the formula $R_1OSO_3Z$ wherein $R_1$ and Z are defined above, such as lithium dodecyl sulfate, sodium dodecyl sulfate, potassium dodecyl sulfate, and sodium tetradecyl sulfate, alkyl sulfonates having the formula $R_1SO_3Z$ wherein $R_1$ and Z are as defined above, such as sodium lauryl sulfonate, sulfated and sulfonated amides and amines, sulfated and sulfonated esters such as lauric monoglyceride sodium sulfate, sodium sulfoethyl oleate, and sodium lauryl sulfoacetate, sulfuric acid ester salts such as sulfated linear primary alcohols, sulfated polyoxyethylenated straight chain alcohols and sulfated triglyceride oils, phosphoric and polyphosphoric acid esters, perfluorinated carboxylic acids, and polymeric anionic surfactants such as alginic acids.

Also included are polymeric anionic surfactants such as salts of polymers of alkyl acrylates and/or alkyl methacrylates and acrylic and/or methacrylic acid, and salts of partial esters of maleic anhydride-styrene copolymers.

Cationic surfactants are similar to anionic surfactants except that the surface-active portion of the molecule has a positive charge. Examples of cationic surfactants include salts of long-chain amines such as primary amines derived from animal and vegetable fatty acids and tall oil and synthetic $C_{12}$–$C_{18}$ primary, secondary, or tertiary amines; diamines and their salts, quaternary ammonium salts including tetraalkylammonium salts and imidazolinium salts derived from e.g. tallow or hydrogenated tallow, or N-benzyl-N-alkyldimethylammonium halides; polyoxyethylenated long-chain amines; quaternized polyoxyethylenated long-chain amines; and amine oxides such as N-alkyldimethylamine oxides (which may be considered zwitterionic) such as cetyl dimethylamine oxide or stearyl dimethylamine oxide.

Zwitterionic surfactants include amino acids such as β-N-alkylaminopropionic acids, N-alkyl-β-iminodipropionic acids, imidazoline carboxylates, N-alkylbetaines, sulfobetaines, and sultaines.

Nonionic surfactants, which are preferred for the present invention, are similar materials in which the polar functionality is not provided by an anionic or cation group, but by a neutral polar group such as typically an alcohol, amine, ether, ester, ketone, or amide function. Typical nonionic surfactants include polyoxyethylenated alkylphenols such as polyoxyethylenated p-nonylphenol, p-octylphenol, or p-dodecylphenol, polyoxyethylenated straight-chain alcohols derived from coconut oil, tallow, or synthetic materials including oleyl derivatives; polyoxyethylenated polyoxypropylene glycols (block copolymers of ethylene oxide and propylene oxide), typically having molecular weights of 1000 to 30,000; polyethylene glycol; polyoxyethylenated mercaptans; long-chain carboxylic acid esters including glyceryl and polyglyceryl esters of natural fatty acids, propylene glycol esters, sorbitol esters, polyoxyethylenated sorbitol esters, polyoxyethylene glycol esters, and polyoxyethylenated fatty acids; alkanolamine "condensates" e.g. the condensates made by reaction of methyl or triglyceride esters of fatty acids with equimolar or twice equimolar amounts of alkanolamine; tertiary acetylenic glycols; polyoxyethylenated silicones, prepared by reaction of a reactive silicone intermediate with a capped alkylene or polyalkylene oxide such as propylene oxide or mixed ethylene oxide/propylene oxide copolymer; N-alkylpyrrolidinones, and alkylpolyglycosides (long chain acetals of polysaccharides). Many of these and other ionic and non-ionic surfactants are discussed in Rosen, "Surfactants and Interfacial Phenomena," John Wiley & Sons, pp. 7–31, 1989.

Further nonionic surfactants more specifically include ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, ethoxylated amines, borated olefin epoxides, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters. Also included are the reaction products of hydrocarbyl-substituted succinic acylating agents and amines. These reaction products and methods for preparing them are described in U.S. Pat. Nos 4,234,435; 4,952,328; 4,938,881; and 4,957,649.

Other nonionic surfactants include functionalized polysiloxanes. These materials contain functional groups such as amino, amido, imino, sulfonyl, sulfoxyl, cyano, hydroxy, hydrocarbyloxy, mercapto, carbonyl (including aldehydes and ketones), carboxy, epoxy, acetoxy, phosphate, phosphonyl, and haloalkyl groups. These polysiloxanes can be linear or branched and generally have molecular weight above 800, i.e. up to 10,000 or 20,000. The functionality can be randomly distributed on the polymer chain or present in blocks. The functionality can be present as alkyl or alkaryl groups as well as groups such as $—(C_2H_4O)_a—(C_3H_6O)_b—R$ where a and b are independently numbers from 0 to 100 provided that at least one of a or b is at least 1, and R is H, acetoxy, or a hydrocarbyl group. Other suitable substituent groups can include $C_3H_6X$, where X is OH, SH, or $NH_2$. Examples of such materials include SILWET™ surfactants from Union Carbide and Tegopren™ silicone surfactants from Goldschmidt Chemical Corp., Hopewell, Va.

Preferred nonionic surfactants include esters of polyols, in particular, partial esters of glycerol where the acid moiety of the ester is a fatty acid of 8 to 24 carbon atoms, preferably about 18 carbon atoms. Particularly preferred are surfactants which comprise in large part glycerol monooleate.

It is preferred that the amount of the surfactant (d) in the composition of the present invention will be 0.05 to 8 percent by weight; more preferably 0.1 to 3% by weight. The amount will be proportionately increased if the present invention is used as a concentrate.

The overbased material

A fifth, and optional, component of the present invention is an overbased acidic material, preferably an alkali or alkaline earth overbased material, especially wherein the alkaline earth metal is calcium or magnesium. Overbased materials are single phase, homogeneous Newtonian systems characterized by a metal content in excess of that which would be present according to the stoichiometry of the metal and the particular acidic organic compound reacted with the metal. The material is preferably a carbonated overbased material, and is particularly preferably a calcium or magnesium salt of a hydrocarbyl sulfonate.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of 1.5, more preferably 3, more preferably 7, up to 40, preferably 25, more preferably 20.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 Normal hydrochloric acid solution using bromophenol blue as an indicator. The overbased materials of the present invention generally have a total base number of at least 20, preferably 100, more preferably 200. The overbased materials generally have a total base number up to 600, preferably 500, more preferably 400. The equivalents of overbased material is determined by the following equation: equivalent weight=(56,100/total base number). For instance, an overbased material with a total base number of 200 has an equivalent weight of 280.5 (eq. wt.=56100/200).

The overbased materials (A) are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter.

The acidic organic compounds useful in making the overbased compositions of the present invention include carboxylic acids, sulfonic acids, phosphorus-containing acids, phenols or mixtures of two or more thereof. Preferably, the acidic organic compounds are carboxylic acids or sulfonic acids with sulfonic acids more preferred. Throughout this specification and in the appended claims, any reference to acids, such as carboxylic, or sulfonic acids, is intended to include the acid-producing derivatives thereof such as anhydrides, lower alkyl esters, acyl halides, lactones and mixtures thereof unless otherwise specifically stated.

The carboxylic acids useful in making the overbased salts (A) of the invention may be aliphatic or aromatic, mono- or polycarboxylic acid or acid-producing compounds. These carboxylic acids include lower molecular weight carboxylic acids (e.g., carboxylic acids having up to 22 carbon atoms such as acids having 4 to 22 carbon atoms or tetrapropenyl-substituted succinic anhydride) as well as higher molecular weight carboxylic acids.

The carboxylic acids of this invention are preferably oil-soluble. Usually, in order to provide the desired oil-solubility, the number of carbon atoms in the carboxylic acid should be at least 8, more preferably at least 18, more preferably at least 30, more preferably at least 50. Generally, these carboxylic acids do not contain more than 400 carbon atoms per molecule.

The lower molecular weight monocarboxylic acids contemplated for use in this invention include saturated and unsaturated acids. Examples of such useful acids include dodecanoic acid, decanoic acid, oleic acid, stearic acid, linoleic acid, tall oil acid, etc. Mixtures of two or more such agents can also be used. An extensive discussion of these acids is found in Kirk-Othmer "Encyclopedia of Chemical Technology" Third Edition, 1978, John Wiley & Sons New York, pp. 814–871, to which attention is directed.

The monocarboxylic acids include isoaliphatic acids. Such acids often contain a principal chain having from 14 to 20 saturated, aliphatic carbon atoms and at least one but usually no more than four pendant acyclic lower alkyl groups. Specific examples of such isoaliphatic acids include 10-methyl-tetradecanoic acid, 3-ethyl-hexadecanoic acid, and 8-methyl-octadecanoic acid. The isoaliphatic acids include mixtures of branch-chain acids prepared by the isomerization of commercial fatty acids (oleic, linoleic or tall oil acids) of, for example, 16 to 20 carbon atoms.

High molecular weight carboxylic acids may also be used in the present invention. These acids have a substituent group derived from a polyalkene. The polyalkene is characterized as containing at least 30 carbon atoms, preferably at least 35, more preferably at least 50, and up to 300 carbon atoms, preferably 200, more preferably 150. In one embodiment, the polyalkene is characterized by an Mn (number average molecular weight) value of at least 500, generally 500 to 5000, preferably 800 to 2500. In another embodiment, Mn varies between 500 to 1200 or 1300.

The polyalkenes include homopolymers and interpolymers of polymerizable olefin monomers of 2 to about 16 carbon atoms. The olefins may be monoolefins such as ethylene, propylene, 1-butene, isobutene, and 1-octene; or a polyolefinic monomer, preferably diolefinic, monomer such 1,3-butadiene and isoprene. Preferably the monomers contain from 2 to 6 carbon atoms, more preferably 2 to 4, more preferably 4. The interpolymers include copolymers, terpolymers, tetrapolymers and the like. Preferably, the polymer is a homopolymer. An example of a preferred polymer is a polybutene, preferably a polybutene in which about 50% of the polymer is derived from isobutylene. The polyalkenes are prepared by conventional procedures.

Illustrative carboxylic acids include palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene (Mn=200–1500, preferably 300–1000), polypropenyl-substituted succinic acid derived from a polypropene, (Mn=200–1000, preferably 300–900), octadecyl-substituted adipic acid, chlorostearic acid, 9-methylstearic acid, dichlorostearic acid, stearyl-benzoic acid, eicosanyl-substituted naphthoic acid, dilauryl-decahydronaphthalene carboxylic acid, mixtures of any of these acids, their alkali and alkaline earth metal salts, and/or their anhydrides. A preferred group of aliphatic carboxylic acids includes the saturated and unsaturated higher fatty acids containing from 12 to 30 carbon atoms. Illustrative of these acids are lauric acid, palmitic acid, oleic acid, linoleic acid, linolenic acid, oleostearic acid, stearic acid, myristic acid, and undecylenic acid, α-chlorostearic acid, and α-nitrolauric acid.

In another embodiment, the carboxylic acids are aromatic carboxylic acids. A group of useful aromatic carboxylic acids are those of the formula

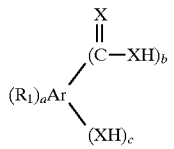

wherein $R_1$ is an aliphatic hydrocarbyl group of preferably 4 to 400 carbon atoms, a is a number in the range of zero to 4, usually 1 or 2, Ar is an aromatic group, each X is independently sulfur or oxygen, preferably oxygen, b is a number in the range of from 1 to 4, usually 1 or 2, c is a number in the range of zero to 4, usually 1 to 2, with the proviso that the sum of a, b and c does not exceed the number of valences of Ar. Preferably, $R_1$ and a are such that there is an average of at least 8 aliphatic carbon atoms provided by the $R_1$ groups. Examples of aromatic carboxylic acids include substituted and non-substituted benzoic, phthalic and salicylic acids or anhydrides.

The $R_1$ group is a hydrocarbyl group that is directly bonded to the aromatic group Ar. $R_1$ preferably contains 6 to 80 carbon atoms, preferably 6 to 30 carbon atoms, more preferably 8 to 25 carbon atoms, and advantageously 8 to 15 carbon atoms. $R_1$ groups may be derived form one or more of the above-described polyalkenes. Examples of $R_1$ groups include butyl, isobutyl, pentyl, octyl, nonyl, dodecyl, 5-chlorohexyl, 4-ethoxypentyl, 3-cyclohexyloctyl, 2,3,5-trimethylheptyl, and substituents derived from polymerized olefins such as polyethylenes, polypropylenes, polyisobutylenes, ethylene-propylene copolymers, chlorinated olefin polymers, oxidized ethylene-propylene copolymers, propylene tetramer and tri(isobutene).

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc.

Within this group of aromatic acids, a useful class of carboxylic acids are those of the formula

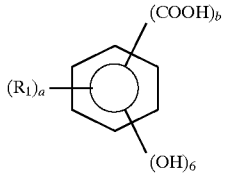

wherein $R_1$ is defined above, a is a number in the range of from zero to 4, preferably 1 to 2; b is a number in the range of 1 to 4, preferably 1 to 2, c is a number in the range of zero to 4, preferably 1 to 2, and more preferably 1; with the proviso that the sum of a, b and c does not exceed 6. Preferably, $R_1$ and a are such that the acid molecules contain at least an average of about 12 aliphatic carbon atoms in the aliphatic hydrocarbon substituents per acid molecule. Preferably, b and c are each one and the carboxylic acid is a salicylic acid.

The salicylic acids can be aliphatic hydrocarbon-substituted salicylic acids wherein each aliphatic hydrocarbon substituent contains an average of at least 8 carbon atoms per substituent and 1 to 3 substituents per molecule. Over-based salts prepared from such salicylic acids wherein the aliphatic hydrocarbon substituents are derived from the above-described polyalkenes, particularly polymerized lower 1-mono-olefins such as polyethylene, polypropylene, polyisobutylene, ethylene/propylene copolymers and the like and having average carbon contents of 30 to 400 carbon atoms are particularly useful.

The sulfonic acids useful in making the overbased salts (A) of the invention include the sulfonic and thiosulfonic acids. Generally they are salts of sulfonic acids. The sulfonic acids include the mono- or polynuclear aromatic or cycloaliphatic compounds. The oil-soluble sulfonates can be represented for the most part by one of the following formulas: $R_2$-T-$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least 15 carbon atoms; and $R_3$ is an aliphatic hydrocarbyl group containing at least 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didode-cylbenzene sulfonic acids, dinonylbenzene sulfonic acids, cetylchlorobenzene sulfonic acids, dilauryl β-naphthalene sulfonic acids, the sulfonic acid derived by the treatment of polybutene having a number average molecular weight (Mn) in the range of 500 to 5000, preferably 800 to 2000, more preferably about 1500 with chlorosulfonic acid, nitronaphthalene sulfonic acid, paraffin wax sulfonic acid, cetyl-cyclopentane, sulfonic acid, lauryl-cyclohexane sulfonic acids, polyethylenyl-substituted sulfonic acids derived from polyethylene (Mn=300–1000, preferably 750), etc. Normally the aliphatic groups will be alkyl and/or alkenyl groups such that the total number of aliphatic carbons is at least 8, preferably at least 12 up to 400 carbon atoms, preferably about 250.

Another group of sulfonic acids are mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from 8 to 30 carbon atoms, preferably 12 to 30 carbon atoms, and advantageously about 24 carbon atoms. Such acids include di-isododecyl-benzene sulfonic acid, polybutenyl-substituted sulfonic acid, polypropylenyl-substituted sulfonic acids derived from polypropene having an Mn=300–1000, preferably 500–700, cetylchlorobenzene sulfonic acid, di-cetylnaphthalene sulfonic acid, di-laurylphenylether sulfonic acid, di-isononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from 100 seconds at 100° F. to 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl-β-naphthyl sulfonic acids, and alkaryl sulfonic acids such as dodecyl benzene "bottoms" sulfonic acids. Dodecyl benzene "bottoms" sulfonic acids are the material left over after the removal of dodecyl benzene sulfonic acids that are used for household detergents. These materials are generally alkylated with higher oligomers. The bottoms may be straight-chain or branched-chain alkylates with a straight-chain dialkylate preferred.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The phosphorus-containing acids useful in making the basic metal salts (A) of the present invention include any phosphorus acids such as phosphoric acid or esters; and thiophosphorus acids or esters, including mono and dithiophosphorus acids or esters. Preferably, the phosphorus acids or esters contain at least one, preferably two, hydrocarbyl groups containing from 1 to 50 carbon atoms, typically 1 to 30, preferably 3 to 18, more preferably 4 to 8.

In one embodiment, the phosphorus-containing acids are dithiophosphoric acids which are readily obtainable by the reaction of phosphorus pentasulfide ($P_2S_5$) and an alcohol or a phenol. The reaction involves mixing at a temperature of about 20° C. to about 200° C. four moles of alcohol or a phenol with one mole of phosphorus pentasulfide. Hydrogen sulfide is liberated in this reaction. The oxygen-containing analogs of these acids are conveniently prepared by treating the dithioic acid with water or steam which, in effect, replaces one or both of the sulfur atoms with oxygen.

In another embodiment, the phosphorus-containing acid is the reaction product of the above-described polyalkene and phosphorus sulfide. Useful phosphorus sulfide-containing sources include phosphorus pentasulfide, phosphorus sesquisulfide, phosphorus heptasulfide and the like.

The reaction of the polyalkene and the phosphorus sulfide generally may occur by simply mixing the two at a temperature above 80° C., preferably between 100° C. and 300° C. Generally, the products have a phosphorus content from 0.05% to 10%, preferably from 0.1% to 5%. The relative proportions of the phosphorizing agent to the olefin polymer is generally from 0.1 part to 50 parts of the phosphorizing agent per 100 parts of the olefin polymer.

The phenols useful in making the basic metal salts (A) of the invention can be represented by the formula $(R_1)_a$—Ar—$(OH)_b$, wherein $R_1$ is defined above; Ar is an aromatic group; a and b are independently numbers of at least one, the sum of a and b being in the range of two up to the number of displaceable hydrogens on the aromatic nucleus or nuclei of Ar. Preferably, a and b are independently numbers in the range of 1 to 4, more preferably 1 to 2. $R_1$ and a are preferably such that there is an average of at least 8 aliphatic carbon atoms provided by the $R_1$ groups for each phenol compound.

While the term "phenol" is used herein, it is to be understood that this term is not intended to limit the aromatic group of the phenol to benzene. Accordingly, it is to be understood that the aromatic group as represented by "Ar", as well as elsewhere in other formulae in this specification and in the appended claims, can be mononuclear such as a phenyl, a pyridyl, or a thienyl, or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be chosen from the group consisting of alkylene linkages, ether linkages, keto linkages, sulfide linkages, polysulfide linkages of 2 to 6 sulfur atoms, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The metal compounds useful in making the basic metal salts (A) are generally any Group 1 or Group 2 metal compounds (CAS version of the Periodic Table of the Elements). The Group 1 metals include Group 1a metals, i.e., alkali metals (sodium, potassium, lithium, etc.) as well as Group 1b metals such as copper. The Group 1 metals are preferably sodium, potassium, lithium and copper, more preferably sodium or potassium, and more preferably sodium. The Group 2 metals of the metal base include Group 2a metals, i.e., the alkaline earth metals (magnesium, calcium, barium, etc.) as well as the Group 2b metals such as zinc or cadmium. Preferably the Group 2 metals are magnesium, calcium, or zinc, preferably magnesium or calcium. Generally the metal compounds are delivered as metal salts. The anionic portion of the salt can be hydroxyl, oxide, carbonate, borate, nitrate, etc.

An acid gas is employed to accomplish the formation of the basic metal salt (A). The acidic gas is preferably carbon dioxide, sulfur dioxide, or sulfur trioxide, and is most preferably carbon dioxide. It is also possible to prepare an overbased material using a first acidic gas, e.g., carbon dioxide, and then to further treat the material with a second acidic gas, e.g., sulfur dioxide, to displace the first gas and provide, in this example, a sulfite overbased material.

A promoter is a chemical employed to facilitate the incorporation of metal into the basic metal compositions. The promoters are quite diverse and are well known in the art, as evidenced by the cited patents. A particularly comprehensive discussion of suitable promoters is found in U.S. Pat. Nos. 2,777,874, 2,695,910, and 2,616,904. These include the alcoholic and phenolic promoters, which are preferred. The alcoholic promoters include the alkanols of one to twelve carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

The overbased materials of the present invention can be further treated, if desired, with other substances in known processes. An example is treatment with a boron source to prepare a borated overbased material; another example is treatment of a sulfite overbased material with a sulfur source to yield a thiosulfate overbased material.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Colloidal (or "gelled") disperse systems can be prepared from the over-based materials described above by homogenizing a "conversion agent" and the overbased starting material. Homogenization is achieved by vigorous agitation of the two components, preferably at the reflux temperature or a temperature slightly below the reflux temperature. The reflux temperature normally will depend upon the boiling point of the conversion agent. However, homogenization may be achieved within the range of 25° C. to 200° C. or slightly higher. Usually there is no real advantage in exceeding 150° C. For further detail on the process of "conversion" to colloidal dispersed systems, reference is made to U.S. Pat. No. 3,492,231.

The amount of the overbased component of the present invention, if it is present, is preferably 0.03 to 5 percent by weight, and more preferably 0.06 to 1 percent by weight. The relative amounts will be proportionally higher if a concentrate is prepared.

Whether the present invention is used as a concentrate or as a fully formulated material, the relative amounts of (b), (c), and (d) employed will preferably be within the relative weight ratios of b:c:d=1–10:0.2–3:0.3–3, and more preferably within the relative weight ratios of b:c:d:= 1–3:0.2–1:0.3–1. When component (e) is also present, the relative weight ratios will preferably be b:c:d:e= 1–10:0.2–3:0.3–3:0.2–3, and more preferably in the range b:c:d:e:=1–3:0.2–1:0.3–1:0.2:1.

Other additives

Other additives can also be used in compositions of the present invention in conventional amounts, including the additives listed below. Antioxidants, corrosion inhibitors, extreme pressure and anti-wear agents include but are not limited to chlorinated aliphatic hydrocarbons, boron-containing compounds including borate esters, and molybdenum compounds. Other additives are viscosity improvers, which include but are not limited to polyisobutenes, polymethacrylate esters, polyacrylate esters, diene polymers, polyalkylstyrenes, alkenylaryl conjugated diene copolymers, polyolefins and multifunctional viscosity improvers. Also included are pour point depressants, which are often included in the lubricating oils described herein. See for example, page 8 of "Lubricant Additives" by C. V. Smalheer and R. Kennedy Smith (Lesius-Hiles Company Publishers, Cleveland, Ohio, 1967). Anti-foam agents can be used to reduce or prevent the formation of stable foam, and include silicones or organic polymers. A particularly suitable antifoam agent is poly(dimethylsiloxane), which is preferably present in an amount of 0.0004 to 0.4 weight percent, preferably 0.001 to 0.1 weight percent, in a fully formulated composition. Examples of these and additional anti-foam compositions are described in "Foam Control Agents," by Henry T. Kerner (Noyes Data Corporation, 1976), pages 125–162. Sulfurized organic materials can also be present. Materials which may be sulfurized to form the sulfurized organic compositions include oils, fatty acids or esters, olefins or polyolefins made thereof, terpenes, or Diels-Alder adducts. Sulfurized olefins can be produced by reacting sulfur monochloride with a low carbon atom olefin, treating the resulting product with an alkali metal sulfide in the presence of free sulfur, and reacting that product with an inorganic base, as described by reference to U.S. Pat. No. 3,471,404. Alternatively, organic polysulfides can be prepared by reacting, optionally under superatmospheric pressure, an olefin with a mixture of sulfur and hydrogen sulfide in the presence or absence of a catalyst, such as an alkyl amine catalyst, followed by removal of low boiling materials. For suitable olefins, sulfurized olefins, and methods of preparing the same, reference is made to U.S. Pat. Nos. 4,119,549, 4,199,550, 4,191,659, and 4,344,854.

Another additive which can be present is a dimercaptothiadiazole or a derivative thereof, which can be used as a copper corrosion inhibitor. These materials are prepared by reaction of $CS_2$ with hydrazine. Dimercaptothiadiazoles consist of a five-membered ring having the structure

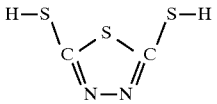

(VIII)

The carbon atoms are substituted by sulfur-containing groups, in particular —S—H (as shown), —S—R, or —S—S—R groups, where R is hydrocarbyl group. Substitution by —S—R groups can be obtained by condensation of (VIII) with an alcohol or by addition of above material to an activated olefin such as an alkyl acrylate; substitution by —S—S—R can be obtained by reaction with an alkyl mercaptan.

These and other additives are described in greater detail in U.S. Pat. No. 4,582,618 (column 14, line 52 through column 17, line 16, inclusive).

EXAMPLES

Examples 1–6

Compositions are prepared by mixing the following components in the amounts indicated below and in Table I. Mixing is accomplished in a beaker or reactor vessel with mechanical stirring.

Oil

A mixture of mineral oils from Sun Oil Company, comprising 70% Sun™ 70 neutral oil and 30% Sun™ 60 neutral oil. (The oil composition used also contains maleic anhydride-styrene viscosity improver and pour point depressant in an amount of 3.29 percent by weight.) This and the other oil compositions listed may contain small amount of other oils normally introduced along with the other ingredients as diluents.

Dithiocarbamate ester

B=The material of formula I, prepared from methyl acrylate

Phosphorus compound

C=dibutyl hydrogen phosphite

F=an amine salt of dibutyl monothiophosphate, wherein the amine is di(hydroxyethyl)tallowamine. ("Tallow" refers to alkyl groups corresponding to the acids comprising tallow oil, predominantly palmitic acid, stearic acid, and oleic acid.). The amine is available from Akzo Chemicals, and is reacted with dibutyl monothiophosphate to prepare the salt.

Surfactant

D=glycerol monooleate

Other

E=magnesium carbonate-overbased synthetic sulfonate, TBN 100.

TABLE 1

| Ex. | Oil % | DTC Ester % | Phosph(ite/ate) % | Surfactant % | Other % |
|---|---|---|---|---|---|
| 1 | 95.68 | B 3.0 | C 0.32 | D 1.0 | |
| 2 | 95.36 | B 3.0 | C 0.32 | D 1.0 | E 0.32 |
| 3 | 95.05 | B 3.0 | F 0.95 | D 1.0 | |
| 4 | 96.55 | B 1.5 | F 0.95 | D 1.0 | |
| 5 | 96.86 | B 1.5 | C 0.32 | D 1.0 | E 0.32 |
| 6 | 97.02 | B 1.5 | C 0.16 | D 1.0 | E 0.32 |

Examples 7–31

Blends are prepared as in Examples 1–6, but with materials added or deleted in the amounts shown in Table 2:

TABLE 2

| Ex. | Ex. from Table 1 | Oil % | Omit | Add % |
|---|---|---|---|---|
| 7 | 2 | 94.67 | E | G 1.01 |
| 8 | 5 | 97.05 | E | H 0.13 |
| 9 | 5 | 96.91 | E | H 0.27 |
| 10 | 5 | 96.96 | E | J 0.22 |
| 11 | 5 | 96.74 | E | J 0.44 |
| 12 | 5 | 96.17 | E | G 1.01 |
| 13 | 6 | 97.21 | E | K 0.13 |
| 14 | 6 | 97.24 | E | L 0.10 |
| 15 | 4 | 6.39 | | E 0.16 |
| 16 | 4 | 96.23 | | E 0.32 |
| 17 | 4 | 95.91 | | E 0.64 |
| 18 | 4 | 96.50 | | L 0.05 |
| 19 | 4 | 96.45 | | L 0.10 |
| 20 | 4 | 96.35 | | L 0.20 |
| 21 | 4 | 96.49 | | M 0.06 |
| 22 | 4 | 96.43 | | M 0.12 |
| 23 | 4 | 96.31 | | M 0.24 |
| 24 | 4 | 96.25 | | N 0.30 |
| 25 | 4 | 95.96 | | N 0.59 |
| 26 | 4 | 95.37 | | N 1.18 |
| 27 | 4 | 95.87 | | G 0.68 |
| 28 | 4 | 95.54 | | G 1.01 |
| 29 | 4 | 96.28 | | H 0.27 |
| 30 | 4 | 96.33 | | J 0.22 |
| 31 | 4 | 96.11 | | J 0.44 |

Added materials

G=a neutral sodium salt of a synthetic alkenylarylsulfonic acid

H=sodium carbonate-overbased polyisobutenylsuccinate, 300 TBN

J=sodium carbonate-overbased natural alkenylarylsulfonate, 300 TBN

K=calcium carbonate-overbased synthetic alkenylarylsulfonate, 300 TBN

L=calcium carbonate-overbased synthetic alkenylarylsulfonate, 300 TBN

M=borated calcium carbonate-overbased natural alkenylarylsulfonate, 300 TBN

N=calcium carbonate-overbased synthetic alkenylarylsulfonate, 13 TBN

Examples 32–55

Blends are prepared as in the previous examples as indicated, but with materials added or deleted in the amounts shown in Table 3:

TABLE 3

| Ex. | Ex. from above | Oil % | Omit | Add % |
|---|---|---|---|---|
| 32 | 5 | 98.05 | E, E | P 0.13 |
| 33 | 5 | 96.92 | E | P 0.26 |
| 34 | 14 | 96.24 | | Q 1.0 |
| 35 | 14 | 95.24 | | Q 2.0 |
| 36 | 6 | 94.83 | E | R 2.01<br>H 0.50 |
| 37 | 14 | 95.23 | | R 2.01 |
| 38 | 5 | 96.76 | | S 0.1 |
| 39 | 5 | 96.56 | | S 0.3 |
| 40 | 5 | 96.76 | | T 0.1 |
| 41 | 5 | 96.56 | | T 0.3 |
| 42 | 5 | 96.76 | | U 0.1 |
| 43 | 5 | 96.56 | | U 0.3 |
| 44 | 5 | 96.86 | D | V 1.0 |
| 45 | 5 | 97.36 | D | W 0.5 |
| 46 | 5 | 97.61 | D | T 0.25 |
| 47 | 5 | 97.36 | D | T 0.50 |
| 48 | 5 | 97.42 | D, E | P 0.26<br>W 0.50 |
| 49 | 5 | 97.42 | D, E | P 0.26<br>T 0.50 |
| 50 | 5 | 97.80 | D, E | P 0.13<br>T 0.25 |
| 51 | 5 | 97.55 | D, E | P 0.13<br>T 0.50 |
| 52 | 14 | 97.74 | D | X 0.50 |
| 53 | 14 | 97.24 | D | X 1.0 |
| 54 | 6 | 96.76 | D | Y 1.27 |
| 55 | 6 | 96.67 | D | Z 1.35 |

Added materials

P=calcium carbonate-overbased tall oil fatty acid carboxylate, 125 TBN

Q=ethoxylated fatty (cocoa) amine (Ethomeen™ C/12 from Akzo Chemical)

R=reaction product of polyisobutenyl succinic anhydride and diethyl ethanolamine S=borated C16 α-olefin epoxide T=ethoxylated fatty (tallow) amine (Ethomeen™ T12), and, in separate examples, ethoxylated hydrogenated fatty (tallow) amine (Ethomeen™ 18/12)

U=oleylamide

V=sulfurized mixture of glycerol monooleate, $C_{16-18}$ olefins and oleic acid

W=1-hydroxyethyl-2-heptadecenyl imidazoline ("Amine O™" from Ciba-Geigy)

X=borated ethoxylated fatty amine (reaction product of 3 moles Ethomeen™ T-12 with 2 moles boric acid)

Y=lecithin

Z=borated lecithin

Examples 55–71

Blends are prepared using the materials and proportions shown in Table 4:

TABLE 4

| Ex. | Oil % | DTC Mat'l % | Phosph-(ite/ate) % | O'based Mat'l % | Surfactant % |
|---|---|---|---|---|---|
| 55 | AA 96.9 | DD 0.1 | C 2.0 | none | SS 1.0 |
| 56 | BB 88.0 | EE 10.0 | C 0.07 | E 0.06 | TT 1.0 |
| 57 | CC 96.4 | FF 1.5 | C 0.05 | E 1.0 | UU 1.0 |
| 58 | CC 87.7 | GG 3.0 | C 8.0 | E 0.3 | VV 1.0 |
| 59 | CC 96.2 | HH 2.0 | F 0.1 | E 0.7 | WW 1.0 |
| 60 | CC 95.5 | JJ 2.0 | F 1.0 | E 0.5 | XX 1.0 |
| 61 | CC 97.5 | B 0.5 | KK 0.5 | E 0.5 | YY 1.0 |
| 62 | AA 93.0 | B 5.0 | LL 0.5 | E 0.5 | ZZ 1.0 |
| 63 | AA 96.9 | B 2.0 | MM 0.5 | E 0.5 | D 0.05 |
| 64 | AA 89.0 | B 2.0 | NN 0.5 | E 0.5 | D 8.0 |
| 65 | AA 96.9 | B 2.0 | 00 0.5 | E 0.5 | D 0.1 |
| 66 | AA 94.5 | B 2.0 | C 0.5 | G 0.03 | D 3.0 |
| 67 | AA 91.5 | B 2.0 | C 0.5 | H 5.0 | D 1.0 |
| 68 | AA 60.0 | B 20.0 | C 5.0 | J 5.0 | D 10.0 |
| 69 | AA 94.1 | B 3.0 | C 0.3 | K 0.6 | D 2.0 |
| 70 | AA 94.5 | B 4.0 | C 0..7 | L 0.3 | D 0.5 |
| 71 | AA 96.0 | B 2.0 | C 0.5 | M 0.5 | D 1.0 |

Additional oils

AA: The oil described for Example 1.

BB: A mixture of sunflower oil and 2-ethylhexyl adipate ester (BASF Glissofluid A-9™)

CC: Mineral oil, Sun™ 70 neutral, without additives.

Additional dithiocarbamate materials

DD: Methylene-bis(di-n-butyldithiocarbamate)

EE: A material akin to formula (I) prepared from the reaction of diethyl amine, carbon disulfide, and methyl acrylate FF: A material akin to (EE), prepared using butyl acrylate GG: A material akin to (EE), prepared from dipropylamine as the amine HH: A material akin to (EE), prepared from di-2-ethylhexylamine as the amine.

JJ: A material akin to (EE), prepared from hexylamine as the amine and butyl acrylate as the activated olefin reactant.

Additional phosphorus materials

KK: The reaction product of phosphoric anhydride with tertiary alkyl primary amine and 2-methylpropyl dithiophosphoric acid-treated propylene oxide LL: The reaction product of isobutyl-amyl-dithiophosphate with methyl acrylate and propylene oxide MM: Sulfurized triphenyl phosphite Additional surfactants SS: Borated $C_{16}$ α-olefin epoxide TT: Alkyl hydrogen phosphite from oleyl alcohol UU: 1-hydroxyethyl-2-heptadecenyl imidazoline VV: ethoxylated fatty (tallow) amine (Ethomeen T12™)

WW: Calcium carbonate-overbased fatty acid carboxylate

XX: Reaction product of $C_{18-24}$ alkenyl succinic anhydride with diethanolamine YY: Calcium carbonate-overbased alkyl salicylate ZZ: Oleylamide In each of the preceding formulations, the total of components may not exactly equal 100% due to rounding.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A lubricating oil composition comprising:

(a) an oil of lubricating viscosity;

(b) about 0.1 to about 10 percent by weight of a compound of the structure $$R_1R_2N—C(X')S—(CR_3R_4)_aY$$

where $R_1$, $R_2$, $R_3$, and $R_4$ are independently hydrogen or hydrocarbyl groups; X' is an oxygen or sulfur atom; a is 1 or 2; and Y is a group which will activate an olefin to which it is attached toward nucleophilic addition, selected from the group consisting of ester groups, acid groups, salt groups, amide groups, ether groups, aldehyde groups, ketone groups, cyano groups, and aryl groups; groups $R_1$, $R_2$, and $(R_3R_4)_aY$ containing in total at least 4 carbon atoms;

(c) about 0.05 to about 8 percent by weight of a phosphorus acid or ester of the formula $(R_6X)(R_7X)P(X)_nX_mR_8$ or an amine salt thereof, where each X is independently an oxygen atom or a sulfur atom, n is 0 or 1, m is 0 or 1, n+m is 1 or 2, and $R_6$, $R_7$, $R_8$ are hydrogen or hydrocarbyl groups; and (d) 0.5 to about 8 percent by weight of a surfactant selected from the group consisting of: glycerol partial esters; sulfurized mixtures of glycerol monooleate, $C_{16-18}$ olefins and oleic acid; 1-hydroxyethyl-2-heptadecenyl imidazoline; lecithin; borated lecithin; and borated $C_{16}$ α-olefin epoxide.

2. The composition of claim 1 wherein X' is a sulfur atom.

3. The composition of claim 1 wherein Y is an ester group, an amide group, or an ether group.

4. The composition of claim 1 wherein Y is $COOR_5$, where $R_5$ is a hydrocarbyl group.

5. The composition of claim 4 wherein $R_1$ and $R_2$ are independently $C_1$ to $C_{18}$ alkyl groups, $R_3$ and $R_4$ are independently hydrogen, methyl, or ethyl, $R_5$ is a $C_1$ to $C_{18}$ alkyl group, and a is 2.

6. The composition of claim 1 wherein the surfactant (d) is a glycerol partial ester.

7. The composition of claim 1 wherein component (c) is a phosphorus ester wherein at least one of $R_6$ and $R_7$ is a hydrocarbyl group and $R_8$ is hydrogen.

8. The composition of claim 7 wherein the phosphorus ester of (c) is of the formula $(R_6O)(R_7O)P(X)_nX_mH$.

9. The composition of claim 1 wherein (c) is a dialkyl hydrogen phosphite.

10. The composition of claim 9 wherein each alkyl group independently contains 1 to about 24 carbon atoms.

11. The composition of claim 9 wherein each alkyl group independently contains about 2 to about 8 carbon atoms.

12. The composition of claim 9 wherein (c) is dibutyl hydrogen phosphite.

13. The composition of claim 1 wherein (c) is an amine salt of a dialkyl monothiophosphate.

14. The composition of claim 13 wherein (c) is an amine salt of a dialkylmonothiophosphate, each alkyl group containing 1 to about 24 carbon atoms and the amine being a tertiary amine containing at least one $C_8$ to $C_{24}$ hydrocarbyl group.

15. The composition of claim 13 wherein the amine is a di(hydroxyalkyl)alkyl amine.

16. The composition of claim 1 wherein the nonionic surfactant is a glycerol partial ester.

17. The composition of claim 16 wherein the glycerol partial ester is glycerol monooleate.

18. The composition of claim 1 further comprising (e) an overbased acidic material.

19. The composition of claim 18 wherein the overbased acidic material is an alkali metal or alkaline earth metal overbased material.

20. The composition of claim 18 wherein the overbased acidic material is an alkaline earth overbased hydrocarbyl sulfonate.

21. The composition of claim 20 wherein the overbased material is a carbonate overbased material.

22. The composition of claim 20 wherein the alkaline earth metal is calcium or magnesium.

23. The composition of claim 20 wherein the alkaline earth metal is calcium.

24. The composition of claim 1 wherein the amount of component (b) is about 0.5 to about 5 percent by weight.

25. The composition of claim 1 wherein the amount of component (b) is about 1.5 to about 3.0 percent by weight.

26. The composition of claim 1 wherein the amount of component (c) is about 0.07 to about 2 percent by weight.

27. The composition of claim 1 wherein the amount of component (c) is about 0.1 to about 1 percent by weight.

28. The composition of claim 1 wherein the amount of component (d) is 0.5 to about 3 percent by weight.

29. The composition of claim 18 wherein the amount of component (e) is about 0.03 to about 5 percent by weight.

30. The composition of claim 29 wherein the amount of component (e) is about 0.06 to about 1 percent by weight.

31. The composition of claim 1 wherein components (b), (c), and (d) are present in the relative weight ratios of b:c:d=1–10:0.2–3:0.3–3.

32. The composition of claim 1 wherein components (b), (c), and (d) are present in the relative weight ratios of b:c:d=1–3:0.2–1:0.3–1.

33. The composition of claim 18 wherein components (b), (c), (d), and (e) are present in the relative weight ratios of b:c:d:e=1–10:0.2–3:0.3–3:0.2–3.

34. The composition of claim 1 wherein the oil is present in a concentrate-forming amount.

35. The composition of claim 18 wherein the oil is present in a concentrate-forming amount.

36. The composition of claim 18 wherein the oil of lubricating viscosity is present in an amount of greater than 20 percent by weight of the composition.

37. A lubricating oil composition comprising:

(a) an oil of lubricating viscosity;

(b) about 0.1 to about 10 percent by weight of a compound of the structure $$R_1R_2N—C(S)S—CR_3R_4CR_3HC(O)OR_5$$

where $R_1$ and $R_2$ are independently $C_1$ to $C_8$ alkyl groups, $R_3$ and $R_4$ are independently hydrogen, methyl, or ethyl groups, and $R_5$ is a $C_1$ to $C_6$ alkyl group;

(c) about 0.05 to about 8 percent by weight of a phosphorus acid or ester of the formula $(R_6X)(R_7X)P(X)_nX_mR_8$ or an amine salt thereof, where each X is independently an oxygen atom or a sulfur atom, n is 0 or 1, m is 0 or 1, n+m is 1 or 2, and $R_6$, $R_7$, and $R_8$ are hydrogen or hydrocarbyl groups; and (d) 0.5 to about 8 percent by weight of a surfactant selected from the group consisting of: glycerol partial esters; sulfurized mixtures of glycerol monooleate, $C_{16-18}$ olefins and oleic acid; 1-hydroxyethyl-2-heptadecenyl imidazoline; lecithin; borated lecithin; and borated $C_{16}$ α-olefin epoxide.

38. The composition of claim 37 wherein component (b) is

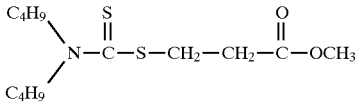

39. The composition of claim 37 wherein the surfactant (d) is a glycerol partial ester.

40. A power transmission fluid comprising the composition of claim 1 and an effective amount of one or more conventional additives for a power transmission fluid.

41. A tractor hydraulic fluid comprising the composition of claim 1 and an effective amount of one or more conventional additives for a tractor hydraulic fluid.

42. A power transmission fluid comprising the composition of claim 18 and an effective amount of one or more conventional additives for a power transmission fluid.

43. A tractor hydraulic fluid comprising the composition of claim 18 and an effective amount of one or more conventional additives for a tractor hydraulic fluid.

44. A concentrate comprising the composition of claim 1, wherein the oil of lubricating viscosity is present in an amount of about 1 to 20 percent by weight of the concentrate.

45. A concentrate comprising the composition of claim 18, wherein the oil of lubricating viscosity is present in an amount of about 1 to 20 percent by weight of the concentrate.

46. The composition of claim 1 wherein the oil of lubricating viscosity is present in an amount of greater than 20 percent by weight of the composition.

47. A lubricating oil composition comprising:

(a) an oil of lubricating viscosity;

(b) about 0.1 to about 10 percent by weight of a compound of the structure $$R_1R_2N—C(S)S—CH_2CH_2C(O)OCH_3$$

where $R_1$ and $R_2$ are independently $C_1$ to $C_8$ alkyl groups;

(c) about 0.05 to about 8 percent by weight of a phosphorus acid or ester of the formula $(R_6O)(R_7O)P(X)_nX_mR_8$ or an amine salt thereof, where each X is independently an oxygen atom or a sulfur atom, n is 0 or 1, m is 0 or 1, n+m is 1 or 2, and $R_6$, $R_7$, and $R_8$ are hydrogen or hydrocarbyl groups; and (d) 0.5 to about 8 percent by weight of a glycerol partial ester surfactant.

* * * * *